United States Patent [19]

Franco et al.

[11] Patent Number: 4,613,999

[45] Date of Patent: Sep. 30, 1986

[54] BED PEDESTAL

[75] Inventors: Eduardo G. Franco, 268 Cattail Cir., Brea, Calif. 92621; James E. Trimmer, Upland, Calif.

[73] Assignee: Eduardo G. Franco, Brea, Calif.

[21] Appl. No.: 580,874

[22] Filed: Feb. 16, 1984

[51] Int. Cl.[4] ..... A47C 19/00; A47C 19/22; A47F 3/00

[52] U.S. Cl. ..... 5/400; 5/201; 5/285; 5/286; 5/308; 312/140

[58] Field of Search ..... 5/58, 308, 200 R, 200 B, 5/200 C, 201, 400, 300, 285, 282 R, 280, 286, 288; 312/111, 140, 257 A, 138

[56] References Cited

U.S. PATENT DOCUMENTS

| | | | |
|---|---|---|---|
| 1,818,404 | 8/1931 | Kaufman | 312/140 |
| 2,079,635 | 5/1937 | Sharp | 312/140 |
| 2,290,615 | 7/1942 | Firestone | 5/308 |
| 2,483,938 | 10/1949 | Rayston | 5/308 |
| 3,419,933 | 1/1969 | Gossen | 312/138 R |
| 3,458,242 | 7/1969 | Williams | 312/138 R |
| 3,736,605 | 6/1973 | Klein, Jr. . | |
| 3,869,738 | 3/1975 | Lawrence | 5/200 R |
| 3,999,236 | 12/1976 | MaCauley . | |
| 4,073,019 | 2/1978 | Fraser . | |
| 4,110,854 | 9/1978 | Sjolie . | |
| 4,186,452 | 2/1980 | Underwood . | |
| 4,391,008 | 7/1983 | Yamaoka et al. | 5/282 R |
| 4,432,590 | 2/1984 | Lawrence et al. | 312/257 A |
| 4,493,425 | 1/1985 | Yoshida | 312/140 |

FOREIGN PATENT DOCUMENTS

| | | | |
|---|---|---|---|
| 153699 | 2/1920 | United Kingdom | 5/308 |
| 579450 | 4/1945 | United Kingdom | 5/308 |

*Primary Examiner*—Gary L. Smith
*Assistant Examiner*—Michael F. Trettel
*Attorney, Agent, or Firm*—Price, Gess & Ubell

[57] ABSTRACT

A waterbed pedestal frame is provided with exterior flat side panels having connector joints on their interior surfaces. A pair of central panels can interconnect a pair of side panels and a plurality of flat, rectangular connector boards can be positioned to space these central panels. Connector posts are provided on the central panel for supporting the weight of the waterbed. The frame can be assembled without additional fasteners by afixing the side panels into a square configuration and interconnecting them with the central panels and the connector members.

14 Claims, 7 Drawing Figures

FIG. 1
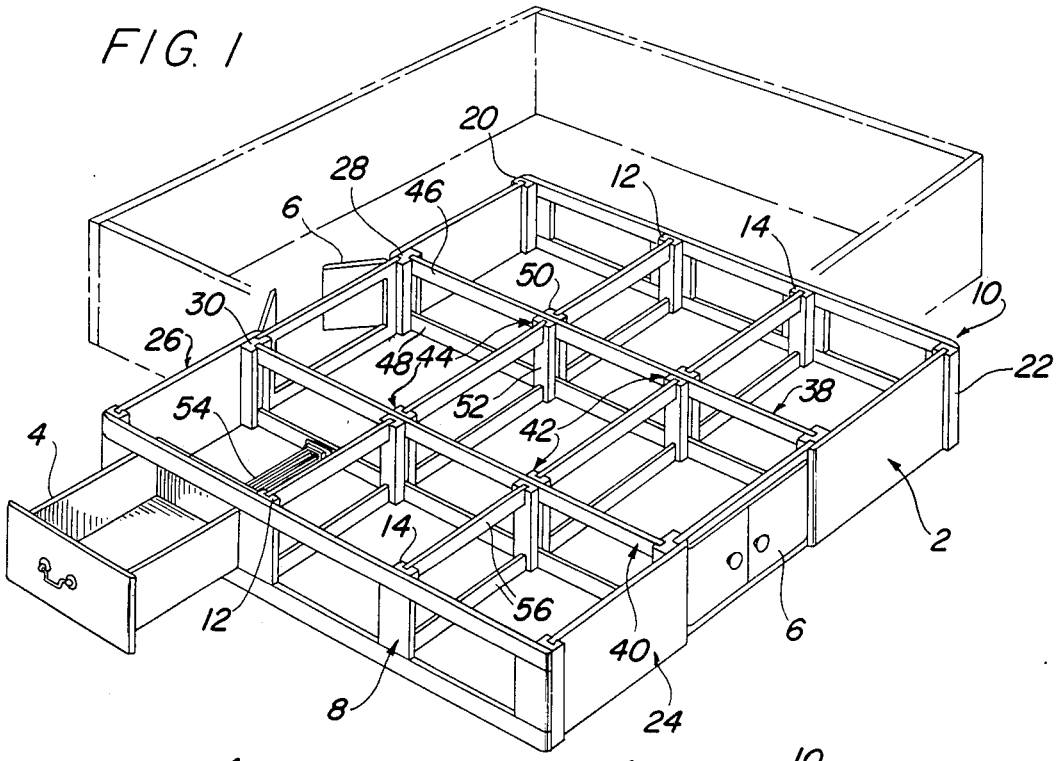
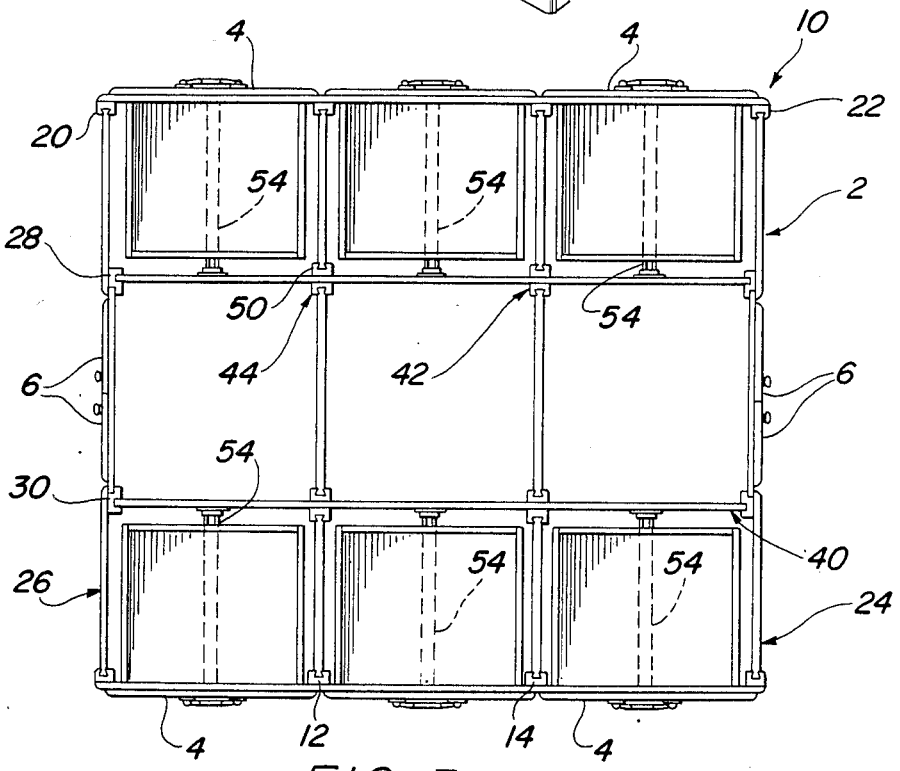
FIG. 3

BED PEDESTAL

BACKGROUND OF THE INVENTION

1. Field of the Invention

The present invention is directed to a pedestal frame for beds, and more particularly to an improved bed pedestal for supporting a sleeping surface such as a waterbed that can be assembled without hand tools and fasteners.

2. Description of the Prior Art

A wide variety of bed pedestal frames and waterbed frames are known in the prior art. For example, it has been known to provide metallic or plastic edge connectors for supporting the side panels of a bed pedestal in the form of a box and further interconnecting slotted boards to provide interior support for the support surface of a waterbed. It has also been known to attach various brackets such as L-shaped brackets to secure the siderails of a bed together with screws to assemble the frame of a waterbed.

Frequently the pedestal of a waterbed frame will also have the capacity of providing storage compartments and drawers to optimize the utilization of the space beneath the bed.

The competition in the manufacturing of frames is extremely rigorous, and the cost of transportation and storage, along with ease of assembling, both by the user and the retailing store, becomes of paramount interest. There is accordingly a need in the prior art to provide a highly efficient waterbed frame pedestal that can be assembled without the necessity of skill, tools or additional fasteners.

SUMMARY OF THE INVENTION

The waterbed frame pedestal of the present invention provides a plurality of substantially flat side panels in combination with a pair of flat internal central panels that can be interconnected together both directly and through the use of single connector members that are appropriately designed to interface with joints on the central panel and side panels. The frame can be shipped in an elongated flat box and assembled without any additional fasteners. Additionally, storage doors and drawers can be integrated into the system at minimal additional cost.

The objects and features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

FIG. 1 is a side perspective view of the present invention;

FIG. 3 is a top plan view of the present invention assembled with drawers and storage compartments.

DESCRIPTION OF THE PREFERRED EMBODIMENTS

The following is provided to enable any person skilled in the furniture industry to make and use the invention, and sets forth the best modes contemplated by the inventors of carrying out their invention. Various modifications, however, will remain readily apparent to those skilled in the above art, since the generic principles of the present invention have been defined herein specifically to provide a relatively economical and easily assembled pedestal frame for a bed.

Referring to FIG. 1, a side perspective view of the pedestal or frame of a bed is disclosed. The present invention is directed to supporting a waterbed mattress, but could be utilized with a conventional mattress. The waterbed frame 2 has a substantially rectangular configuration and is capable of interfacing with and supporting an upper frame such as the retaining walls for a waterbed mattress that has been illustrated by the phantom lines in FIG. 1. As can be readily appreciated, the lower waterbed frame or pedestal has to support a substantial amount of weight, while at the same time providing a highly pleasing and esthetic configuration to the purchaser. Competitive demands of the furniture industry and particularly the waterbed industry requires a relatively inexpensive product that can be easily assembled by a person of minimal skill. The cost of shipping the product to the retail stores is also of considerable interest, and the more compact the unassembled waterbed frame can be shipped, the lower the shipping cost will be per truckload. It is further advantageous to provide a waterbed frame pedestal system that can be modified to provide different models or upgraded to provide additional features such as drawers 4 and storage doors 6.

Figure 2:
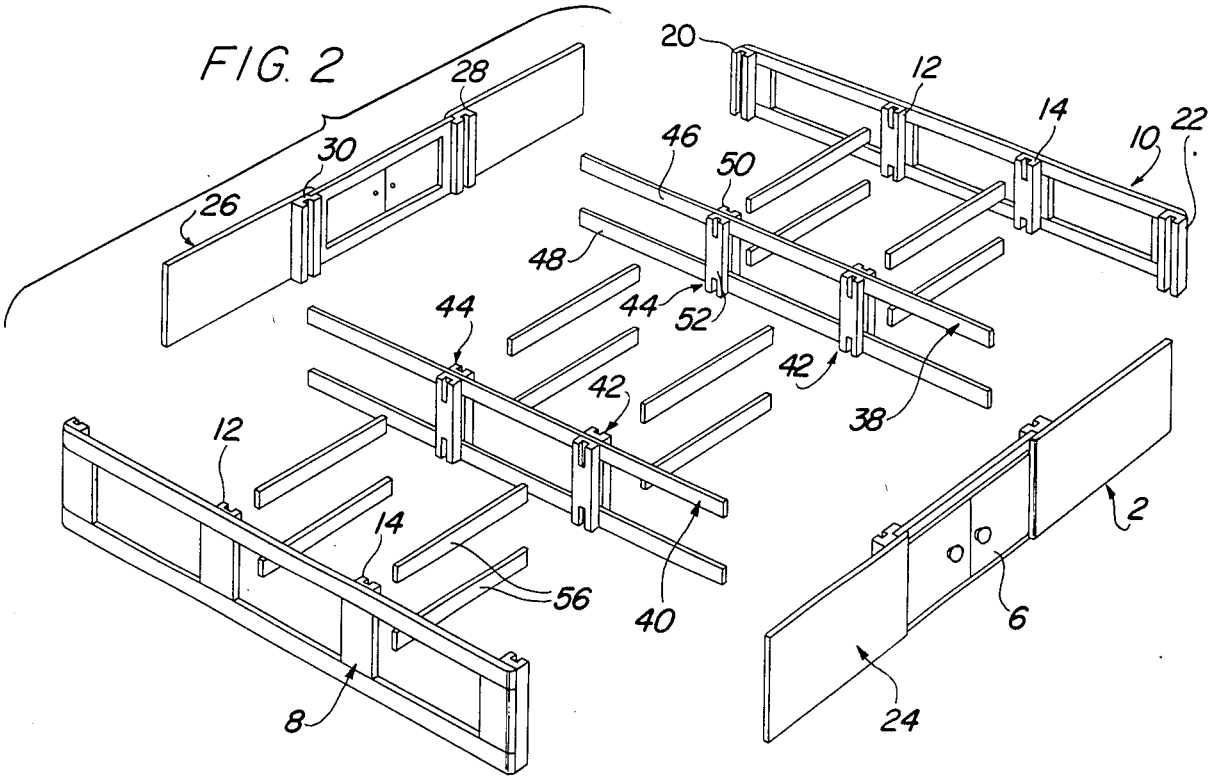
FIG. 2 is a exploded perspective view of the present invention.
Figure 4A:
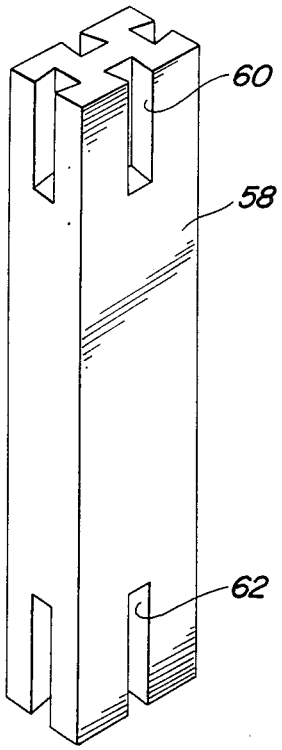
FIGS. 4*a* through 4*d* are side perspective views of various connector joint assemblies of the present invention.
Figure 4B:
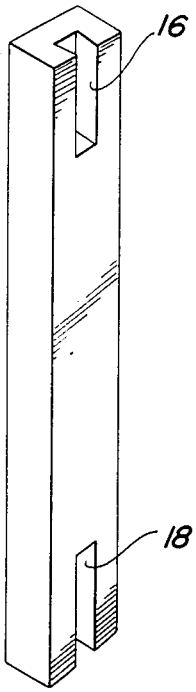
Figure 4C:
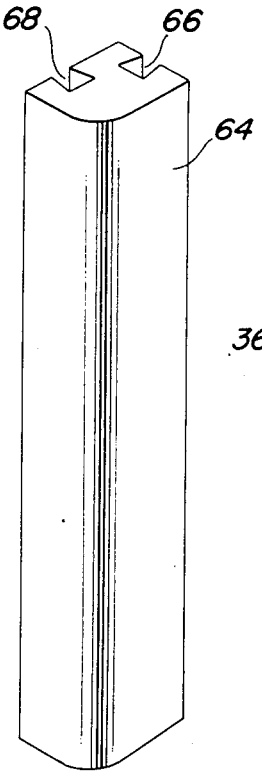
Figure 4D:
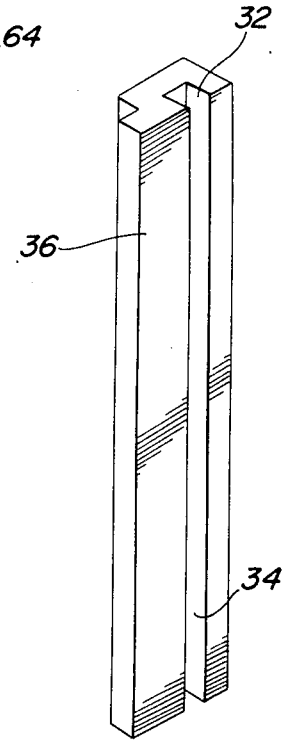

In the embodiment shown in FIG. 1, four substantially flat side panels are disclosed. Side panels 8 and 10 are identical and include a series of rectangular openings for receiving drawers such as drawer 4. As can be readily appreciated, the side surfaces can be solid or decorative on the exterior if the drawers are to be eliminated. On the interiors of the respective side panels 8 and 10 are a pair of central joint assemblies 12 and 14. These joint assemblies can have a configuration as disclosed in FIG. 4*b* with separate upper and lower dovetail slots 16 and 18 axially aligned on one surface of the joint assembly. Connector assemblies are also provided at either end of the side panels as elements 20 and 22 with a dovetail slot or groove running the entire length of an elongated block. Side panels 24 and 26 are also identical and include a pair of central joint assemblies 28 and 30, that also provide upper and lower slots 32 and 34 and a cantilevered retaining flange 36, as can be seen in FIG. 4*d*. While dovetail slots can be provided in the joint assemblies 28 and 30, the preferred embodiment utilizes a straight sided groove. A pair of retaining flanges 36 are designed to be capable of securing the position of a storage door assembly 6 as seen in FIG. 1.

A pair of central panels 38 and 40 also include connector joints 42 and 44. The central panels 38 and 40 and their connector joints 42 and 44 can be made by a combination of a pair of spaced upper and lower support rails 46 and 48 that are juxtapositioned and secured by a pair of elongated rectangular support posts 50 and 52. Appropriate fasteners such as staples can be utilized to hold the support rails and support posts together since the primary forces in use will be of a compressive nature due to the weight of the waterbed mattress. As can be appreciated, drawer tracks 54 can also be mounted between the lower support rails 48 and the lower portion of the side panels 8 and 10. As an alternate embodiment a single central panel can be used if the connector joints are of sufficient strength to support the weight of the mattress.

Finally, a plurality of connector members 56 of a flat, elongated rectangular configuration can be utilized to connect at least the interior connector joints of the central panels 38 and 40 and the side connector joints 12 and 14 to permit the frame to be assembled without any additional fasteners or tools. The connector members are also utilized to interconnect the central panels 38 and 40. The ends of the connector members 56 and side panels 24 and 26 have a complementary dovetail shape.

In the preferred embodiment, each of the component parts of the pedestal frame are formed or cut from wood.

As can be appreciated, alternative joint assemblies can also be utilized such as, for example, the intermediate connector joint 58 formed from an elongated rectangular wooden block having a pair of slots 60 and 62 on each side face of the joint. Each of the respective slots are positioned at one end of the block and are of a configuration compatible with joining the connector members 56. In summary, four slots positioned at 90° displacements are provided at each end of the block.

Additionally, an end connector assembly 64 having a pair of dovetail slots 66 and 68 which extend down the entire length of the connector can be used as an alternative to the end connectors 20 and 22 disclosed in FIG. 1. Thus the intermediate connector block 58 can be used to interconnect connector members 56 and to replace the upper and lower support rails 46 and 48 on the central panels 38 and 40. As can be appreciated, three connector members will be necessary to replace each of the support rails. Likewise, the end connector assembly block 64 can be utilized to replace the end connector assemblies 20 and 22, and four, then, will be provided for that purpose.

While the preferred embodiment of the present invention is disclosed in the specification and drawings, it should be realized that once given the teachings of the present invention, that various modifications would be possible to a person or ordinary skill in the furniture industry, and accordingly the metes and bounds of the present invention should be measured solely from the following claims.

What is claimed is:

1. An improved waterbed pedestal frame capable of a compact shipping configuration and of being assembled without additional fasteners, comprising:

four substantially flat side panels, each side panel having at least two side connector joints on one surface thereof and two of the side panels having end connector joints at either end of their panels of a configuration to receive and retain the ends of the other side connector panels to form a frame with each side panel having its flat surface lying in a vertical plane with each side connector joint, including elongated slots, being vertically aligned opposite to another connector joint on another side panel;

a pair of central panels connected respectively to the connector joints of each pair of side panels and having intermediate connector joints, each central panel includes a pair of support posts and support rails with an opening positioned between the support rails, each support post is bifurcated into a pair of elongated rectangular wooden blocks that are also spaced apart by the support rails, each wooden block has vertically aligned upper and lower elongated slots to form the intermediate connector joints; and a plurality of substantially flat elongated rectangular connector means of a substantially less vertical height than the flat side panels, removably mounted in the slots of the intermediate connector joints of the central panel and the side connector joints of the side panels, whereby the frame can be assembled without any additional fasteners by affixing the side panels into a square configuration and interconnecting them with the central panels and the connector members.

2. The invention of claim 1 wherein at least some of the joints and slots have a dovetail configuration and the ends of the connector members and support rails have complementary configurations to lock the frame elements together.

3. The invention of claim 2 wherein the support rails are elongated flat rectangular boards of wood.

4. The invention of claim 1 further including four end connectors having slots at 90° positions for securing the respective ends of the side panels together.

5. The invention of claim 1 wherein each connector joint on the side panels is formed from an elongated block having a cantilevered retaining flange along one side and an axially aligned slot.

6. The invention of claim 5 further including a door assembly for mounting behind the retaining flanges.

7. The invention of claim 6 further including sliding drawers and drawer rails mounted between a central panel and a side panel.

8. An improved pedestal frame for supporting a sleeping surface of a bed that can be assembled and disassembled without tools and fasteners and can further be compactly shipped, consisting of:

four substantially flat side panels having an exterior surface and an interior surface, the interior surface including two intermediate connector joint assemblies with separate upper and lower slots;

a pair of central panel members connectable to the slots of the connector joint assemblies on a pair of side panels and having intermediate connector joints, each central panel includes a pair of support posts and support rails with an opening between the support rails, the support posts are bifurcated into a pair of elongated rectangular wooden blocks that are spaced apart by the support rails to form the intermediate connector joints;

means for connecting the ends of the side panels together; and a plurality of substantially flat elongated rectangular connector members connected to at least the intermediate connector joints of the central panels, and the side connector joints of a second pair of said panels, a pair of connector members being connected to each joint assembly in a parallel spaced apart manner so that their flat surfaces are aligned in vertical planes, whereby the frame can be assembled without additional fasteners by affixing the side panels with the connector means into a square configuration and interconnecting them with the central panels and connector members.

9. The invention of claim 8 wherein at least some of the joints and slots have a dovetail configuration and the ends of the connector members and support rails have complementary configurations to lock the frame elements together.

10. The invention of claim 9 wherein the support rails are elongated flat rectangular boards of wood.

11. The invention of claim 8 wherein the means for connecting includes four end connectors having slots at 90° positions for securing the respective ends of the side panels together.

12. The invention of claim 8 wherein each connector joint on the side panels is formed from an elongated block having a cantilevered retaining flange along one side and an axially aligned slot.

13. The invention of claim 12 further including a door assembly for mounting behind the retaining flanges.

14. The invention of claim 13 further including sliding drawers and drawer rails mounted between a central panel and a side panel.

* * * * *